US006813454B2

(12) United States Patent
Nozawa

(10) Patent No.: US 6,813,454 B2
(45) Date of Patent: Nov. 2, 2004

(54) METHOD AND IMAGE FORMING APPARATUS HAVING A PICTURE ELEMENT COUNTER

(75) Inventor: Taizo Nozawa, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/424,730

(22) Filed: Apr. 29, 2003

(65) Prior Publication Data

US 2003/0202815 A1 Oct. 30, 2003

(30) Foreign Application Priority Data

Apr. 30, 2002 (JP) ..... 2002-128874

(51) Int. Cl.[7] ..... G03G 15/08; G03G 21/02

(52) U.S. Cl. ..... 399/79; 399/27

(58) Field of Search ..... 399/79, 27, 28; 347/131, 140, 158

(56) References Cited

U.S. PATENT DOCUMENTS 5,349,377 A * 9/1994 Gilliland et al. ..... 347/131
5,797,067 A * 8/1998 Mitekura ..... 399/79
6,064,838 A * 5/2000 Maruta et al. ..... 399/79
6,542,702 B2 * 4/2003 Ahn et al. ..... 399/27

* cited by examiner

*Primary Examiner*—Sophia S. Chen
(74) *Attorney, Agent, or Firm*—Foley & Lardner LLP

(57) ABSTRACT

Each picture element of an image is divided into a plurality of picture elements, a latent image corresponding to the divided picture elements is formed on a photosensitive member, and the latent image is then developed with a developing agent to print it on a paper-sheet. Then, there is counted the number G of the divided picture elements which become targets of the development among the divided picture elements.

16 Claims, 6 Drawing Sheets

Screen displaying toner consumption state

| | Number of used paper-sheets | Average print area rate Ea (%) on paper-sheet | Print area rate E (%) on last paper-sheet | Toner consumption fee M (¥) per paper-sheet |
|---|---|---|---|---|
| Copy mode | 100,000 | 8.7 | 7.7 | 0.73 |
| Printer mode | 500 | 11.2 | — | 0.93 |
| Fax mode | 200 | 10.3 | — | 0.86 |
| Total or average | 100,700 | 10.1 | 7.7 | 0.84 |

Outwardly transmit  Print

METHOD AND IMAGE FORMING APPARATUS HAVING A PICTURE ELEMENT COUNTER

CROSS-REFERENCE TO RELATED APPLICATIONS

This application is based upon and claims the benefit of priority from the prior Japanese Patent Application No. 2002-128874, filed Apr. 30, 2002, the entire contents of which are incorporated herein by reference.

BACKGROUND OF THE INVENTION

1. Field of the Invention

The present invention relates to an image forming apparatus for reading an image depicted on an original to print it on a sheet, and a method for controlling the image forming apparatus.

2. Description of the Related Art

An image forming apparatus such as a copy machine optically reads an image on an original set on an original table, forms an electrostatic latent image corresponding to the read image on the surface of a photosensitive drum, and develops (visualizes) the electrostatic latent image with a developing agent (toner) to print (transmit) it on a paper-sheet. The formation of the electrostatic latent image on the photosensitive drum is performed by scanning with a laser beam radiated from a semiconductor laser, for example, a laser diode.

The scanning with the laser beam is linearly performed along the axial direction of the photosensitive drum. The linear scanning is referred to as primary scanning. The primary scanning is repeatedly performed by rotation of the photosensitive drum. Sequential movement of the primary scanning by the rotation of the photosensitive drum is referred to as secondary scanning.

The image read from the original is composed of a number of picture elements. The primary scanning and the secondary scanning are performed by "on" and "off" the laser beam in accordance with these picture elements.

The actual "on" and "off" of the laser beam are performed in accordance with each picture element in one case, or in accordance with plural divided portions, for example, 4 divided portions of each picture element in another case. By the "on" and "off" in accordance with each divided picture element, edge portions of the read images can be reproduced in detail on the sheet. This is a so-called multi-segment smoothing process.

On the other hand, the developing agent (toner) for developing the electrostatic latent image on the photosensitive drum is consumable, and it much be replenished regularly or when needed. For this replenishment, a user is burdened with a fee. The consumption of the developing agent, which burden the user with the fee, is an important concern to the user.

Conventionally, the consumption fee of the developing agent is calculated on the basis of the number of the used paper-sheets at a store or a rental store of the apparatus. The thus calculated consumption fee is demanded of the user.

The amount of the images to be printed on the sheets varies, and it cannot be accurately grasped only from the number of the used paper-sheets. Therefore, there is possibility that an improper fee is demanded of the user.

BRIEF SUMMARY OF THE INVENTION

An object of the present invention is to provide a reliable image forming apparatus and a method for controlling the apparatus, wherein a consumption of developing anent can be exactly grasped and thus a fee burden to a user can be clarified.

An image forming apparatus of the present invention divides each picture element of an image into a plurality of picture elements, forms a latent image corresponding to each of the divided picture elements on a photosensitive member, and then develops the latent image with a developing agent to print it on a paper-sheet, and the image forming apparatus includes a count section for counting the number of the divided picture elements which become targets of development among the divided picture elements.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

In the following, one embodiment of the present invention will be described referring to attached drawings.

Figure 1:
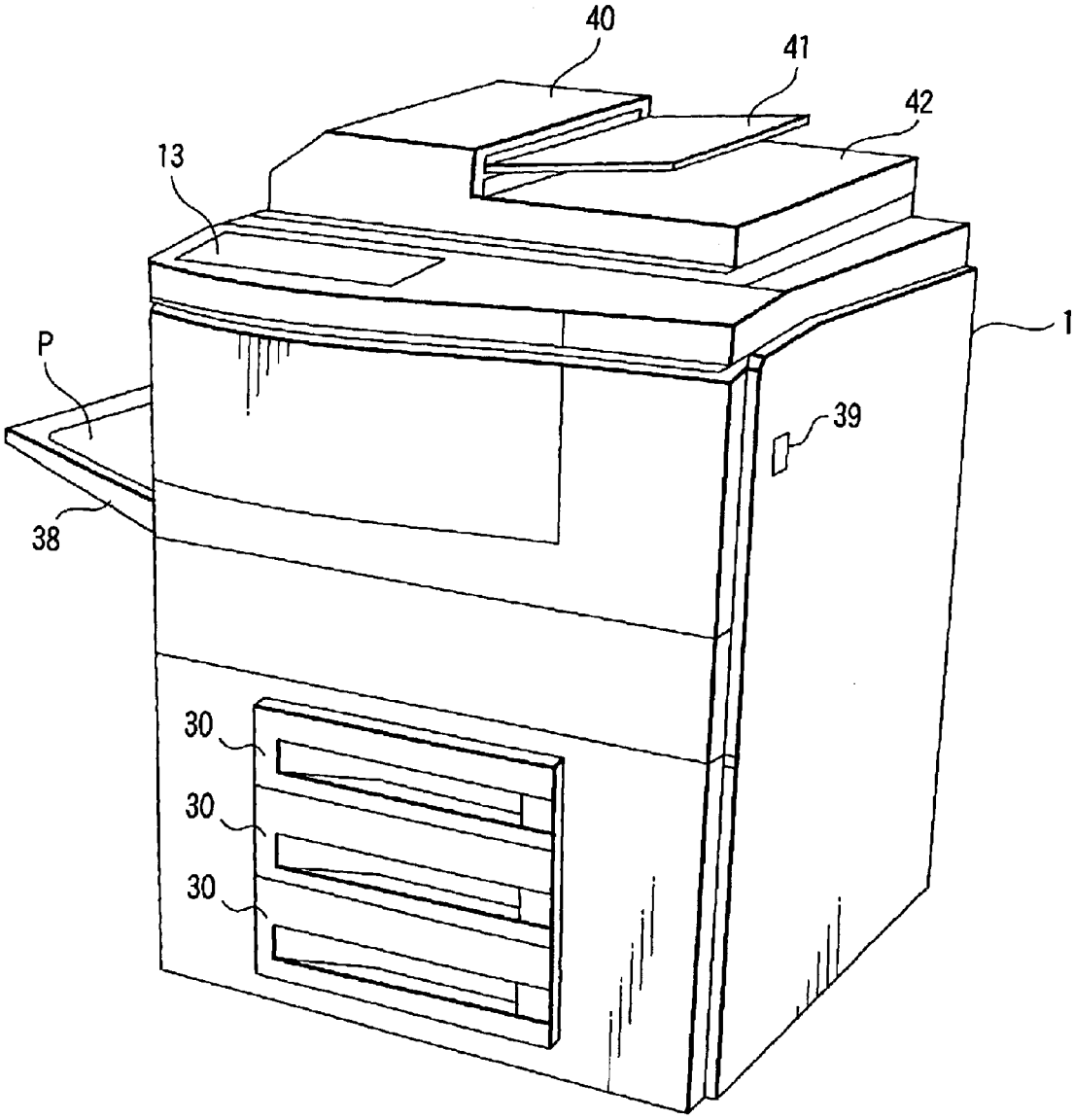
FIG. 1 is a perspective view showing an appearance of one embodiment.
Figure 2:
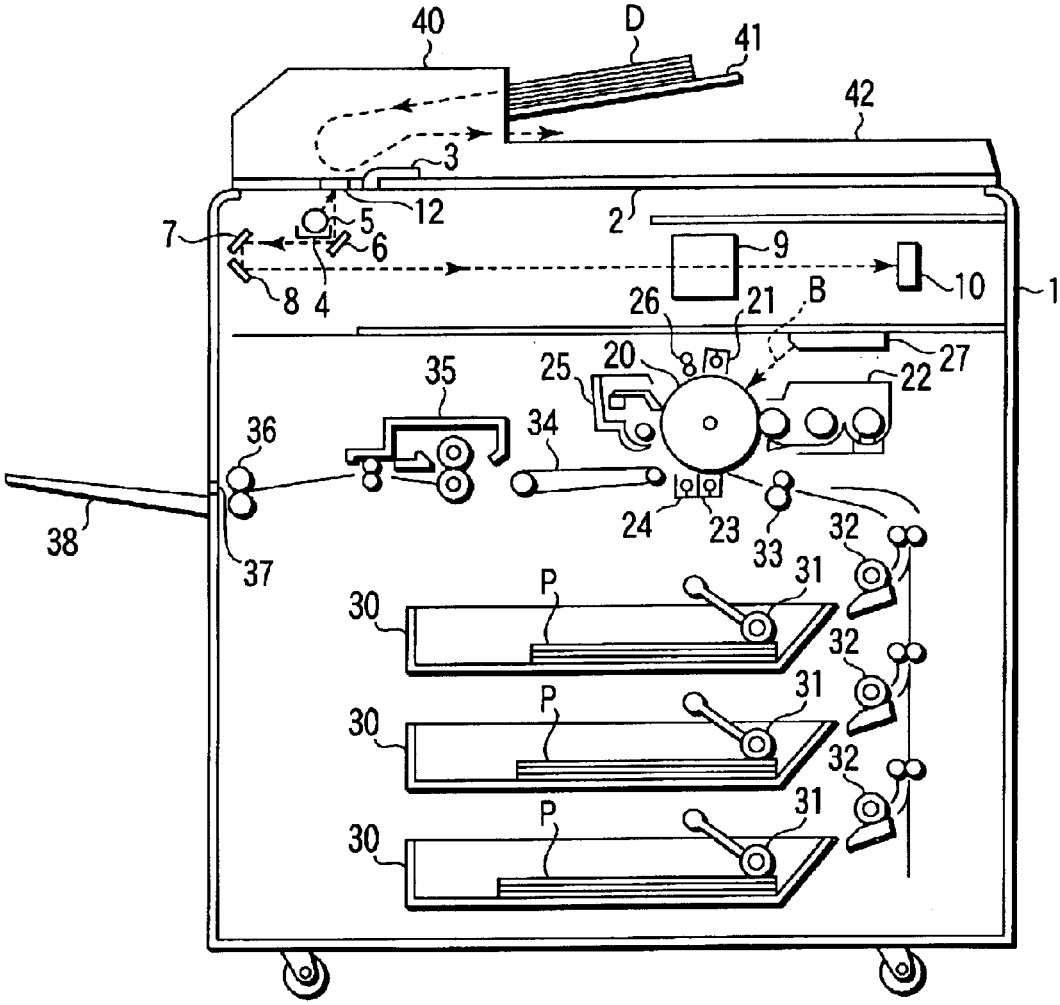
FIG. 2 is a cross-sectional view showing the configuration of the interior of the embodiment.

As shown in FIG. 1 and FIG. 2, a transparent original table (glass plate) 2 for mounting an original is disposed on an upper surface portion of a main body 1. An indicator 3 is disposed on one side of the original table 2. A step between the indicator 3 and the original table 2 functions as a reference position for setting the original.

A plurality of original sensors 11 which will be described later are provided on a lower surface side of the original table 2. Presence/absence and a size of originals D which are set on the original table 2 are optically detected by these original sensors 11.

A carriage 4 is disposed under the original table 2, and an exposure lamp 5 is disposed on the carriage 4. The carriage 4 and the exposure lamp 5 constitute an exposure means. The carriage 4 can move (reciprocate) along the lower surface of the original table 2. While the carriage 4 reciprocally moves along the original table 2, the original D mounted on the original table 2 is exposed to light by switching on the exposure lamp 5.

A reflected light image from the original D can be obtained through this exposure, and the image is projected onto a CCD (charge coupled device) 10 via reflection mirrors 6, 7, 8 and a lens block 9 for changing magnification. The CCD 10 has a large number of photoelectric transducer elements on an acceptance region of the light, and image signals corresponding to the image on the original D are outputted by linearly scanning the acceptance region of the light and repeating the linear scanning operation.

The image signals outputted from the CCD 10 are amplified and converted into digital signals in a signal processing section 93 which will be described below, and the digital signals are properly processed in an image processing section 55 which will be described below, and then supplied to a laser unit 27. The laser unit 27 emits a laser beam B in accordance with the inputted signals.

A window 12 for reading the original is disposed at a position adjacent to the indicator 3 of the original table 2. The window 12 has a shape and a size corresponding to a longitudinal length of the indicator 3.

An automatic original feeder (ADF) 40 doubling as an original table cover is disposed in an operable manner over the original table 2, the indicator 3 and the window 12. The automatic original feeder 40 having a tray 41 for mounting the originals thereon feeds a plurality of the originals set on the tray 41 one by one to the window 12, passes them on the window 12, and then discharges the passed originals onto a tray 42. When the automatic original feeder 40 is operated, the exposure lamp 5 emits the light at a position opposite to the window 12, and with the light, the window 12 is irradiated. The original D which is passing on the window 12 is exposed through the window 12 to the light with which the window 12 is irradiated.

A reflected light image from the original D can be obtained by this exposure, and the image is then projected onto the CCD 10 via the reflection mirrors 6, 7, 8 and the lens block 9 for changing magnification.

Figure 3:
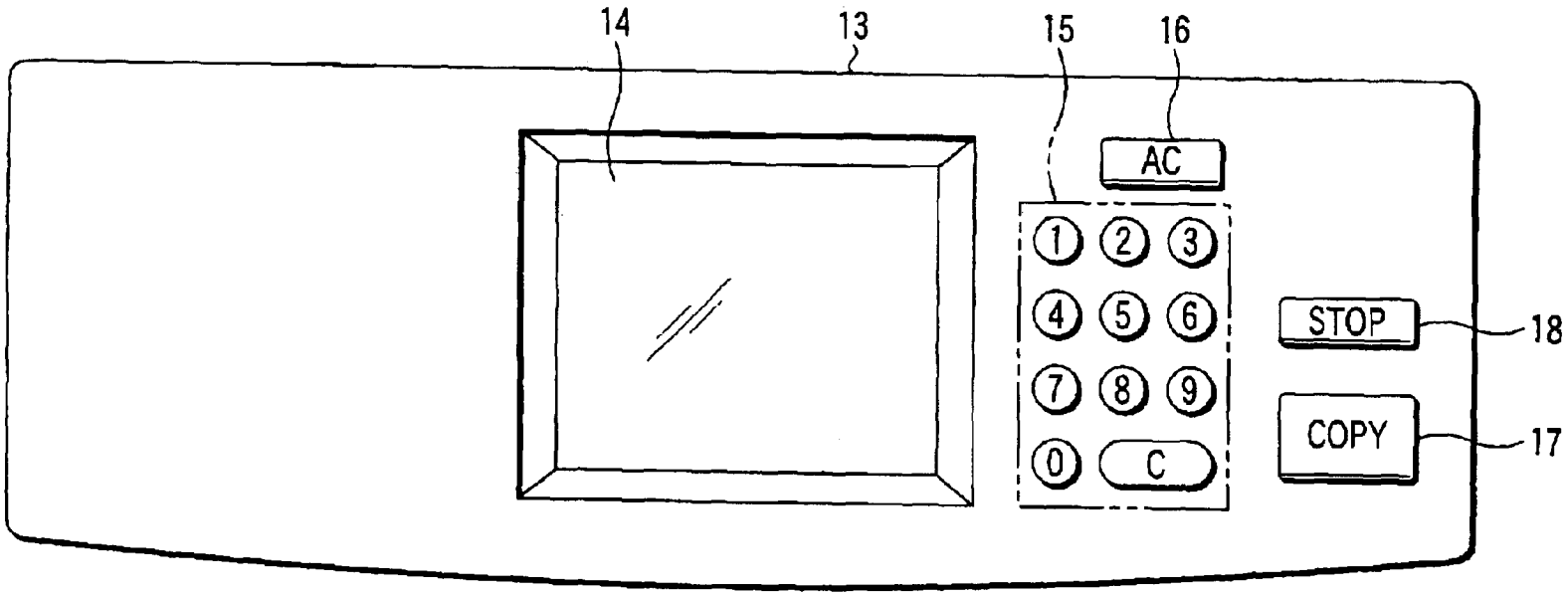
FIG. 3 is a schematic diagram showing the configuration of a control panel of the embodiment.

As an operating section for setting operation conditions, a control panel 13 is disposed at a position not overlapped with the automatic original feeder 40 on the upper surface portion of the main body 1. As shown in FIG. 3, the control panel 13 includes a liquid crystal display section 14 of a touch panel type, a ten-key 15 for inputting a numerical value, an all reset key 16, a copy key 17, and stop key 18. The liquid crystal display section 14 is capable of inputting information by a touch operation of fingers and displaying various kinds of information including inputted information. By touching the liquid crystal display section 14 with the fingers, it is possible to set a kind of image and conditions of image formation, to specify a size of the paper-sheet P which will be described below, and to input various codes for maintenance or service.

On the other hand, a photosensitive drum 20 is rotatably disposed at a substantially central portion in the main body 1. Around the photosensitive drum 20, there are sequentially provided an electrifier 21, a developer 22, a transcriber 23, an exfoliator 24, a cleaner 25, and a de-electrifier 26. Furthermore, the laser beam B emitted from the above laser unit 27 is applied onto the surface of the photosensitive drum 20 through a space between the electrifier 21 and the developer 22.

A toner supply cartridge containing a developing agent, i.e., a toner is detachably attached to the developer 22. By the attachment of the toner supply cartridge, the developer 22 is supplied with the toner.

A plurality of sheet containers, i.e., sheet cassettes 30 are disposed on the bottom of the main body. In the sheet cassettes 30, a number of paper-sheets P of different sizes are contained. When a copy key 17 is pushed, the paper-sheets P are taken out one by one from any one of the paper-sheet cassettes 30. To take out the paper-sheets, pick-up rollers 31 are attached to the sheet cassettes, respectively. The paper-sheet P thus taken out is separated from the sheet cassette 30 by a separator 32, and sent to a pair of resist rollers 33. The resist rollers 33 feeds the paper-sheet P between the photosensitive drum 20 and the transcriber 23 at timing when the rotation of the photosensitive drum 20 is taken into account.

The above electrifier 21 generates electrostatic charges on the surface of the photosensitive drum 20 by applying a high electric voltage to the photosensitive drum 20 to electrify it. The surface of the thus electrified photosensitive drum 20 is irradiated with the laser beam B emitted from the laser unit 27. The laser unit 27 primarily scans (linear scanning) the surface of the photosensitive drum 20 in one direction and simultaneously performs secondary scanning which repeats the primary scanning with the rotation of the photosensitive drum 20, thereby forming an electrostatic latent image corresponding to the image read from the original D on the surface of the photosensitive drum 20.

The electrostatic latent image on the photosensitive drum 20 is developed by receiving the toner from the developer 22 to become a visible image. The visible image is transcribed to the paper-sheet P by the transcriber 23. The paper-sheet P on which the image is thus printed is peeled off from the photosensitive drum 20 by the exfoliator 24. There remain the developing agent and the electric charges on the surface of the photosensitive drum 20 from which the paper-sheet P has been peeled off. The remaining developing agent is removed with the cleaner 25. The remaining electric charges are removed by a de-electrifier 28.

The paper-sheet P peeled off from the photosensitive drum 20 is transferred to a fixing device 35 by a conveyer belt 34. The fixing device 35 fixes the transcribed image on the paper-sheet P by heating. The fixed paper-sheet is transferred to a discharge exit 37 by a sheet discharge roller 36, and then discharged through the discharge exit 37 onto a tray 38 which is outside the main body 1.

On the other side of the main body 1, a power switch 39 is disposed.

Figure 4:
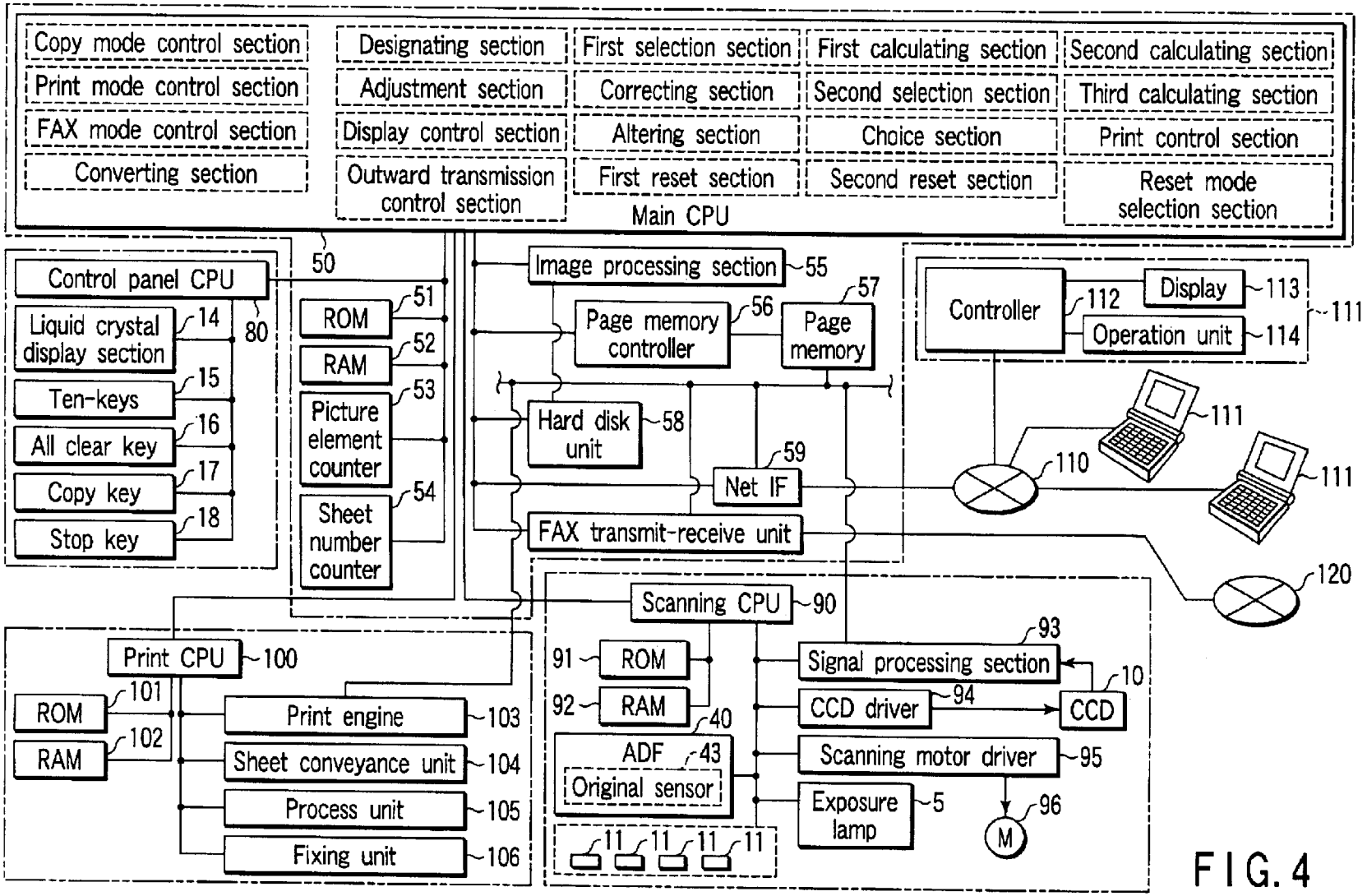
FIG. 4 is a block diagram of a control circuit of the embodiment.

A whole control circuit of the apparatus is shown in FIG. 4.

To a main CPU 50, there are connected a control panel CPU 80, a scanning CPU 90, and a print CPU 100. The main CPU 50 overall controls the control panel CPU 80, the scanning CPU 90 and the print CPU100, and includes a copy mode control section in accordance with the operation of the copy key 17, a printer mode control section in response to the image input into a net-interface 59 which will be described below, and a FAX (facsimile) mode control section in response to the image reception at a FAX receiving unit 79 described below.

Furthermore, to the main CPU 50 connected are a ROM 51 for storing control programs, a RAM 52 for storing data, a picture element counter 53, a sheet number counter 54, an image processing section 55, a page memory controller 56, a hard disk unit 58, the net-interface 59, and a FAX transmit-receive unit 60. The page memory controller 56 controls the writing and the reading out of the image data in the page memory 57. Furthermore, by an image data bus 61, there are interconnected the image processing section 55, the page memory controller 56, a page memory 57, the hand disk unit 58, the net-interface 59, and the FAX transmit-receive unit 60.

The above net-interface 59 acts as an input section for a printer mode to which the image sent from external equipment is inputted. A communication network 110 such as LAN, an Internet is connected to the net-interface 59, and to the communication network 110 connected are external equipment, for example, a plurality of the personal computers 111. These personal computers 111 include a controller 112, a display 113, and an operation unit 114.

The above FAX transmit-receive unit 60 is connected to a telephone line 120 and also acts as a reception section in a facsimile mode for receiving the image (image data) sent by facsimile through the telephone line 120.

To control panel CPU 80 connected are the above liquid crystal display section 14, a ten-keys 15, an all reset key 16, a copy key 17, and a stop key 18.

To the scanning CPU 90 connected are ROM 91 for storing control programs, a RAM 92 for storing data, a signal processing section 93 for processing the output of the above CCD 10 to supply it to the above image data bus 61, a CCD driver 94, a scanning motor driver 95, the exposure light 5, the automatic original feeder 40, a plurality of the original sensors 11, etc. The CCD driver 94 drives the above CCD 10. The scanning motor driver 95 drives a scanning motor 96 for driving the cartridge. The automatic original feeder 40 has an original sensor 43 for detecting the originals D and the sizes thereof.

A reading section for reading optically the images of originals in the copy mode is composed of mainly the scanning CPU 90 and its peripheral constituents.

To the print CPU 100 connected are a ROM 101 for storing a control program, a RAM 102 for storing data, a print engine 103, a sheet conveyance unit 104, a process unit 105, and a fixing unit 106. The print engine 103 is composed of the above laser unit 27, a driving circuit thereof, etc. The paper-sheet conveyance unit 104 is composed of a sheet conveyance mechanism extending from the above sheet supply cassettes 30 to the tray 38, a driving circuit thereof, etc. The process unit 105 is composed of the above photosensitive drum 20, its peripherals, etc. The fixing unit 106 is composed of the above fixing device 35, its driving circuit, etc.

A print section for printing the image processed in the above image processing section 55 on the sheets P in the sheet cassettes 30 is mainly composed of the print CPU 100 and its peripheral components.

Now, the above image processing section 55 has a function to divide a number of picture elements (normal picture elements) composing the image processed by the image processing section into a plurality of picture elements, for example 4 picture elements, respectively as well as the function to perform normal image processing with the read image in the above reading section, the inputted image into the net interface 59, and the received image in the above FAX transmit-receive unit 60. On-off operations of the laser unit 27 corresponding to the divided picture elements make the latent image corresponding to each divided picture element imaged on the photosensitive drum 20 by the primary scanning and the secondary scanning with the laser beam B from the laser unit 27. By means of the on-off operations of the laser beam B corresponding to each divided picture element, the edge portions of the image can be reproduced in details on the paper-sheet P.

Figure 5:
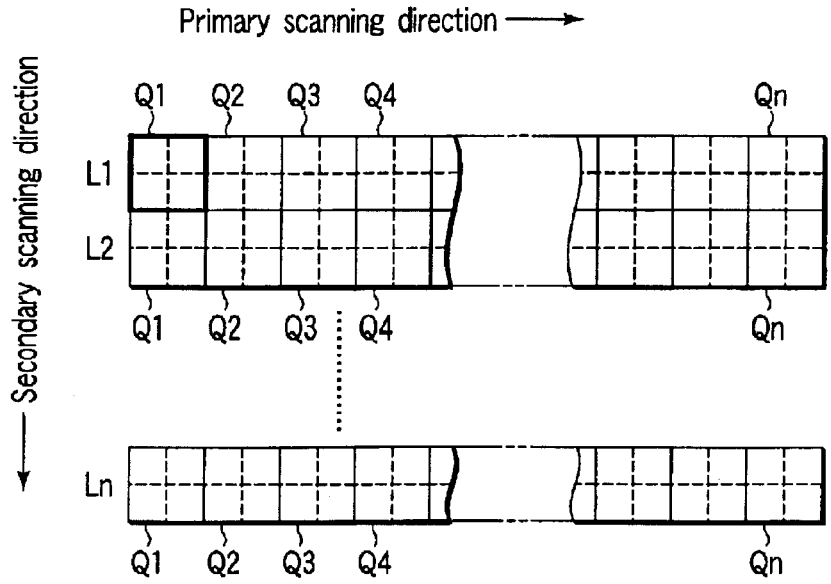
FIG. 5 is a schematic view showing a pattern of usual picture elements and a pattern of divided picture elements formed on a photosensitive drum of the embodiment.

A pattern of the picture elements (normal picture elements) and a pattern of the divided picture elements of the image (electrostatic latent image) formed on the photosensitive drum 20 are shown in FIG. 5. A row Q1, Q2, . . . Qn of the picture elements is formed along the direction of the primary scanning (linear scanning), and the row is sequentially arranged in the order of L1, L2, . . . Ln along the direction of the secondary scanning. The patterns Q1, Q2, . . . Qn of the picture elements are each composed of 4 divided picture elements Qa, Qb, Qc, Qd.

Figure 6:
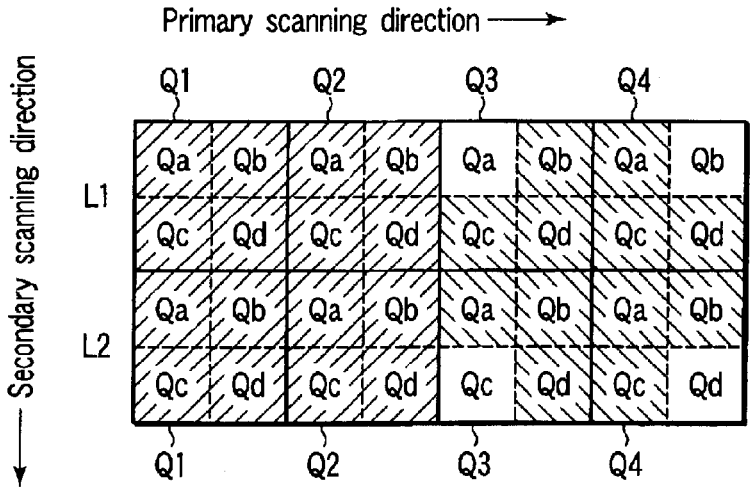
FIG. 6 is a schematic view showing an example of an image imaged on the photosensitive drum of the embodiment by the use of the divided picture elements.

For example, when printing a square image pattern, all the divided picture elements Qa, Qb, Qc, Qd of the picture elements Q1, Q2 in the primary scanning L1, L2 are turn black (shown with oblique lines) by "on" of the laser beam B, as shown in FIG. 6. When printing a circular image pattern, the divided picture elements Qb, Qc, Qd of the picture element Q3 in the primary scanning L1, the divided picture elements Qa, Qc, Qd of the picture element Q4 in the primary scanning L1, the divided picture elements Qa, Qb, Qd of the picture element Q3 in the primary scanning L2, and the divided picture elements Qa, Qb, Qc of the picture element Q4 in the primary scanning L2 are turn black (shown with oblique lines), respectively, by "on" of the laser beam B.

The above picture element counter 53 counts, every mode such as a copy mode, a printer mode or a FAX mode, the number G of the divided picture elements which become the targets of the development (the divided picture elements which make the laser beam B turn on) among the divided picture elements forming the image processed in the image processing section 55.

The above sheet number counter 54 counts, every mode such as the copy mode, the printer mode or the FAX mode, the number U of the paper-sheets P which are taken out of the sheet supply cassettes 30 and on which the image is printed. It is to be noted that since the paper-sheets P different in size are received in a plurality of sheet supply cassettes 30, respectively, there is provided in the main CPU 50 a converting section for converting the number U of the used paper-sheets P to the number Ux of the paper-sheets P having a reference size on the basis of a relation between the size of the paper-sheets and the beforehand designated reference size.

As the reference sizes, plural sizes such as A3 size, LD size, A4 size, LT size are prepared. In a case where the reference number is A3 , when 2 paper-sheets P of the A4 size are used, the counted value U of the sheet number counter 54 is "2", but the converted number Ux is "1" in the converting section. On the contrary, in a case where the reference number is A4 , when 1 paper-sheet P of the A3 size is used, the counted value U of the sheet number counter 54 is "1", but the converted number Ux is "2" in the converting section.

The above RAM 52 functions as a first memory section and a second memory section. The first memory section stores, every reference size, the number Gs of the reference divided picture elements per unit area rate of the print area rate on the paper-sheet P, when an original of the reference size on which the image is depicted at a standard print area rate (also referred to as an occupied area rate of the image) Es, i.e., a reference chart is read by the present apparatus and printed on the paper-sheet P. The second memory section similarly stores, every reference size, a reference toner (developing agent) consumption fee Ms per unit area rate of the print area rate on the paper-sheet P, when the reference chart is read by the present apparatus and printed on the paper-sheet P.

Figure 7:
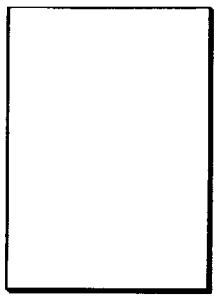
FIG. 7 is a schematic view showing an example of a sheet having a print area rate of 0% in the embodiment.
Figure 8:
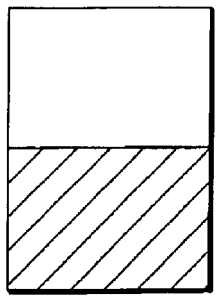
FIG. 8 is a schematic view showing an example of a sheet having a print area rate of 50% in the embodiment.
Figure 9:
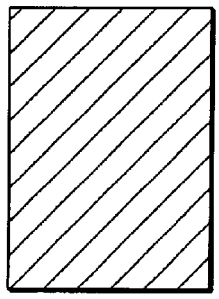
FIG. 9 is a schematic view showing an example of a sheet having a print area rate of 100% in the embodiment.

The print area rate is a value obtained by dividing the total area of the image, which is the target of the development, by the total area of the paper-sheet P. Accordingly, the print area rate is 0% in a case of a blank sheet on which nothing is printed as shown in FIG. 7; it is 50% in a case where the total area of the image, which is the target of the development, occupies half of the paper-sheet as shown in FIG. 8; and it is 100% in a case where the total area of the image, which is the target of the development, occupies the total area of the paper-sheet (the whole surface of the sheet is blackened) as shown in FIG. 9.

The standard print area rate Es of the reference chart is, for example, 6%. When the reference chart is read by the present apparatus and printed on the paper-sheet P, the number of the divided picture elements forming 1% of the image on the paper-sheet P is the so-called number Gs of the reference divided picture elements per unit area rate.

For example, when the image whose entire surface is blacken is printed on the A3 size paper-sheet, the number of normal picture elements forming the image which is the target of the development is 72M (mega), and the number of the divided picture elements obtained by dividing each normal picture element into 4 areas is 288M (mega) (=72M×4). Therefore, when the reference chart having the reference size of A3 and the standard print area rate Es of, e.g., 6% is read and printed, the number of the normal picture elements forming the image which is the target of the development is 4.32M (=72M×0.06), and the number of the divided picture elements is 17.28M (=4.32M×4).

The main CPU 50 has, as principal functions, the following sections (1) to (16) in addition to the copy mode control section, the print mode control section, the FAX mode control section and the converting section mentioned above.

(1) A designating section for designating the reference size in accordance with the operation of the control panel 13.

(2) A first selection section for selecting the number Gs of the reference divided picture elements corresponding to the reference size designated in the above designating section among numbers Gs of the reference divided picture elements in the RAM 52.

(3) A first calculating section for calculating the print area rate E on the paper-sheet P, every paper-sheet P and every mode (copy mode, printer mode or FAX mode), by dividing the counted number G of the picture element counter 53 by the number Gs of the reference divided picture elements selected in the above first selection section.

(4) A second calculating section for successively accumulating print area rates E calculated in the above first calculating section, and for calculating an average print area rate Ea every mode by dividing the accumulated value by the converted number Ux of the above converting section.

(5) An adjusting section for adjusting the number Gs of the reference divided picture elements in the RAM 52 in accordance with the operation of the control panel 13.

(6) A correcting section which corrects, to 100%, a value near to 100% and larger than a set value E2, and corrects, to 0%, a value near to 0% and smaller than a set value E1 among the print area rates E calculated in the first calculating section.

(7) A second selection section for selecting the reference toner consumption fee Ms corresponding to the reference size designated in the above designating section among reference toner consumption fees Ms in the RAM 52.

(8) A third calculating section for calculating, every mode, a toner consumption fee M per used paper-sheet P by multiplying the average print area rate Ea calculated in the above second calculating section by the reference toner consumption fee Ms selected in the above second selection section.

(9) A display control section for displaying the converted number Ux of the above converting section, the average print area rate Ea calculated in the second calculating section and the toner consumption fee M calculated in the third calculating section together with the print area rate E last calculated at present among each print area rates E calculated in the first calculating section, as the display screen of the toner consumption state, on the liquid crystal display section 14 of the control panel 13. Furthermore, an informing section is composed of the display control section and the liquid crystal display section 14.

(10) An altering section for altering the reference toner consumption fee Ms in the RAM 52 in accordance with the operation of the control panel 13.

(11) A choice section for choosing whether or not the display screen of the toner consumption state is displayed on the liquid crystal display section 14 in accordance with the operation of the control panel 13.

(12) A print control section for printing the display contents of the display screen of the toner consumption state in the liquid crystal display section 14 on the paper-sheet P as an image formation output of the present apparatus.

(13) An outward transmission section for outward transmitting the displayed contents of the display screen of the toner consumption state in the liquid crystal display section 14 through the communication networks 110.

(14) A first reset section for resetting the counted value G of the picture element counter 53 and the counted value U of the sheet number counter 54 by the operation of the control panel 13.

(15) A second reset section for automatically resetting the counted value G of the picture element counter 53 and the counted value U of the sheet number counter 54 when replacing a toner supply cartridge in the developer 22.

(16) A reset mode selection section for selecting one of a mode for performing the first reset section and a mode for performing the second reset section by the operation of the control panel 13.

Next, operations of the above constitution will be described.

Once an original D is set on the original table 2, the state of the setting is detected by each original sensor 11 and the size of the original is also detected by each of the original sensors 11. Then, the copy key is pushed to read the image of the original D on original table 2, and to store the read image (image data) in the page memory 57.

When the image (image data) transmitted from the personal computer 111 via the communication network 110 is inputted into the net interface 59, the inputted image (image data) is stored in the page memory 57.

When the image (image data) transmitted by a facsimile through a telephone line 120 is received the FAX transmit-receive unit 60, the received image (image data) is also stored in the page memory 57.

The image stored in the page memory 57 is image-processed in the image processing section 55. The processed image composed of a large number of picture elements (normal picture element) and each of the picture elements is divided into 4 pieces to become the divided picture elements. With on-off operations of the laser unit 27 corresponding to the divided picture elements, the electrostatic latent image corresponding to each divided picture element is imaged on the photosensitive drum 20 by the primary scanning and the secondary scanning on the photosensitive drum with the laser beam B emitted from the laser unit 27. By means of the on-off operations of the laser unit 27, the edge portions of the image can be reproduced in details on the paper-sheet.

The electrostatic latent image imaged on the photosensitive drum 20 is developed to a visible image receiving a toner from the developer 22. The visible image is transcribed to the paper-sheet P with the transcriber 23. The paper-sheet P on which the image is printed is peeled off from the photosensitive drum 20 with the exfoliator 24, and is transferred to the fixing device 35 with the conveyer belt 34. The fixing device 35 fixes the transcribed image on the paper-sheet P by heating. The paper-sheet P fixed by the fixing device 35 is transferred to a discharge exit 37 by the sheet discharge roller 36 and discharged through the discharge exit 37 onto the tray 38 outside the main body 1.

At the time of printing the image, the number G of the divided picture elements (divided picture elements making the laser unit 27 perform an on-operation), which become the target of the development by the developer 22 among each divided picture element composing the image image-processed in the image processing section 55 is counted by the picture element counter 53 every mode (copy mode, printer mode or FAX mode).

At the same time, the number U of the paper-sheets P taken out of the sheet supply cassettes 30 for images to be printed thereon is counted by the sheet number counter 54 every mode. The counted number U of the used paper-sheets P is converted to the number Ux of the paper-sheets having the reference size on the basis of relation between the size of the used sheets and the beforehand designated reference size. For example, in a case where the reference number is A3 and when two paper-sheets P of the A4 size are used, the counted value U of the sheet number counter 54 is "2", but the converted number Ux is "1" in the converting section. On the contrary, in a case where the reference number is A4 and when 1 paper-sheet P of the A3 size is used, the counted value U of the sheet number counter 54 is "1", but the converted number Ux is "2" in the converting section.

Every one print of the sheet, the print area rate E on the paper-sheet P is calculated every mode (copy mode, printer mode or FAX mode) by dividing the number G counted with the picture element counter 53 by the number Gs of the reference divided picture elements in the RAM 52.

As mentioned above, the normal picture elements are not counted, but the number G of the divided picture elements forming the normal picture elements is counted, and from the number G, the print area rate E is calculated, whereby a consumption state of the toner which is used for image print can be accurately detected. A relation between the calculated print area rate E and the actual print area rate is shown in FIG. 10, and both are approximately equal.

The calculated print area rates E are sequentially accumulated, and the accumulated value is divided by the converted number Ux, whereby the average print area rate Ea is calculated every mode.

The toner consumption fee M per sheet of the used paper-sheets P is calculated every mode by multiplying the calculated average print area rate Ea by the reference toner consumption fee Ms in the RAM 52.

Figures 10, 11:
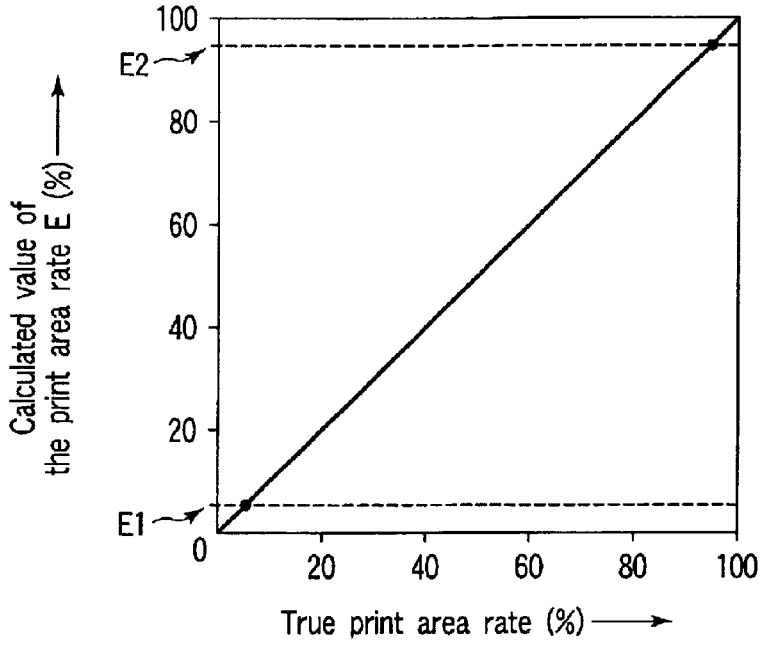
FIG. 10 is a graph showing a relation between a calculated print area rate and an actual print area rate in the embodiment.
FIG. 11 is a schematic view of a screen displaying a toner consumption state displayed on a liquid crystal display section in the embodiment.

Then, as shown in FIG. 11, the number of the used paper-sheets P (the converted number Ux), the average print area rate Ea (%), the print area rate E (%) on the final sheet last calculated at present among print area rates E, and the toner consumption fee M (¥) are displayed in the from of a list as a display screen of the toner consumption state on the liquid crystal display section 14. In the display screen of the toner consumption state, values of the respective modes are separately shown, and a total or an average of the respective modes are shown.

By displaying the display screen of the toner consumption state, a maintenance man and a user can accurately grasp the toner consumption state which burden the user with the fee. Accordingly, the fee which is the burden to the user can be clarified, which can remarkably improve reliability.

It is to be noted that there is a display pattern of a "print" button on the display screen of the toner consumption state. By touching the "print" button, the display contents of the display screen of the toner consumption state are printed on the paper-sheet P. In consequence, the toner consumption state can be retained as a visible record on the paper-sheet.

Further, there is a display pattern of a "transmit outward" button on the display screen of the toner consumption state. By touching the "transmit outward" button, the display contents of the display screen of the toner consumption state can be transmitted to an external equipment (a personal computer 111, etc.) of a previously set address through the communication network 110. Accordingly, the toner consumption state can be collected and kept in the form of electronic data in an instrument at a manufacturer, etc.

In addition to the functions described above, the present invention has the following functions (a) to (e).

(a) There are a mode of displaying the display screen of the toner consumption state as an exclusive image at the time of maintenance/service, and a mode of always displaying the display screen of the toner consumption state irrespective of the maintenance/service. When a code is input on the control panel 13, either of the modes can be selected.

(b) When a code is input on the control panel 13, any of the A3 size, the LD size, the A4 size, the LT size, etc. can be designated as the reference size. The reference size depends on a nation, a local region, a store, a lease store, etc.

The number Gs of the reference divided picture elements is stored in the RAM 52 every reference size, and one of the numbers Gs of the reference divided picture elements corresponding to the reference size designated above is selected and used to calculate the print area rate E. By this selection, it is possible to calculate the proper print area rate E even if the reference size changes.

The reference toner consumption fee Ms is stored in the RAM 52 every reference size, and one of the reference toner consumption fee Ms corresponding to the reference size designated above is selected and used to calculate the toner consumption fee M. By means of this selection, it is possible to calculate the proper toner consumption fee M in spite of a change in the standard specification for the reference size.

(c) By inputting the code to the control panel 13, each number Gs of the reference divided picture elements can be adjusted.

That is to say, the density of the image, which has been depicted on the reference chart is privately defined by the manufacturer of the apparatus considering the general conditions in usage of the apparatus. Although the print area rate E is calculated using the image read and printed from the reference chart as the reference, the amount of consumed toner comes to vary between the site where the originals with denser image density are preferably used and the site where the originals with thinner image density are preferably used because of the variety of nations or regions where the apparatus is really used even if the originals have the same size and print area rate as on another.

Therefore, it is designed that the number Gs of each reference divided picture elements can be appropriately adjusted. By means of this adjustment, it is possible to calculate the proper toner consumption fee M grasping the accurate amount of toner consumption independent of nations, regions, etc.

In a case where the number Gs of the reference divided picture elements is adjusted to the increasing side, however, the calculated print area rate E becomes a few percents smaller than the true 100%, when the image being the target of the development the total area of the which occupies the total area of the paper-sheet (the whole surface of the paper-sheet is blackened) is printed. On the contrary, in a case where the number Gs of the reference divided picture elements is adjusted to the deceasing side, the calculated print area rate E becomes a few percents larger than the true 100%, when the sheet the whole surface of which is blackened is printed. The print area rate larger than 100% cannot exist.

When the sheet the whole surface of which is almost white is printed, the adjustment of the number Gs of the reference divided picture elements makes the print area rate E an improper value.

In order to overcome such a disadvantage, with regard to the calculated print area rate E as shown in FIG. 10, a value near to 100% and larger than the prescribed value E2 is corrected to 100%, and a value near to 0% and smaller than the prescribed value E1 is corrected to 0%. From the print area rate E after the correction calculated is the average print area rate Ea.

(d) By inputting the code to the control panel 13, each reference toner consumption fee in the RAM 52 can be altered corresponding to the operation of the control panel 13. This is for coping with price fluctuations.

(e) The counted value G in the picture element counter 53 and the counted value U in the sheet number counter 54 can be reset functioning the first reset mode for resetting the value in sequence corresponding to the input of the code to the control panel 13 at the time of maintenance/inspection, or functioning the second reset mode for resetting automatically resetting the value when replacing the toner supply cartridge in the developer 22. The functioning either of these 2 reset modes can be selected by inputting either of the codes to the control panel 13.

By performing the count reset corresponding to the input of the code at the time of maintenance/inspection and the count reset automatically when replacing the toner supply cartridge in the picture element counter 53, and also by performing the count reset corresponding to the input of the code at the time of maintenance/inspection and the count reset automatically when replacing the toner supply cartridge in the sheet number counter 53, the print area rate E, the average print area rate Ea, and the toner consumption fee M can be calculated by both the maintenance/inspection standard and the cartridge replacement standard. In this case, the calculated results by the maintenance/inspection standard and the calculated results by the cartridge replacement standard can be stored in the hard disk unit 58, and the display screen of the toner consumption state by the maintenance/inspection standard and the display screen of the toner consumption state by the cartridge replacement standard can be selectively displayed in the liquid crystal display section 14. The selection can be done also by inputting the code on the control panel 13.

Besides, in the above embodiment, the description was given using the print of a monochromatic image as an example, but the process can be applied in the same manner to a print of a color image. In performing the print of the color image, the toner consumption state can be grasped every color.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image forming apparatus comprising:

an original table;

a reading section which optically reads an image on an original set on the original table;

a printing section which divides each picture element of the image read in the reading section into a plurality of picture elements, forms a latent image on a photosensitive member in accordance with the divided picture elements, and then develops the latent image with a developing agent to print it on a paper-sheet;

a picture element counter which counts, every paper-sheet, the number G of the divided picture elements which become targets of the development among the divided picture elements;

a first memory section which stores the number Gs of reference divided picture elements per unit area rate of a print area rate on the paper-sheet, when the original of a reference size on which the image is depicted at a standard print area rate Es is read by the present apparatus and printed on the paper-sheet;

a first calculating section which calculates a print area rate E on the paper-sheet by dividing the counted value G of the picture element counter by the number Gs of the reference divided picture elements in the first memory section;

a sheet number counter to count the number U of the used paper-sheets;

a second calculating section which accumulates results E calculated in the first calculating section and calculates an average print area rate Ea by dividing the accumulated value by the counted value U of the sheet number counter; and an informing section which informs the counted value U of the sheet number counter and the average print area rate Ea calculated in the second calculating section, and informs the print area rate E last calculated at present among the print area rates E calculated in the first calculating section.

2. An apparatus of claim 1, further comprising:

an operating section;

an adjusting section which adjusts the number Gs of the reference divided picture elements in the first memory section in accordance with the operation of the operating section; and a correcting section which corrects, to 100%, a value near to 100% and larger than a set value E2, and corrects, to 0%, a value near to 0% and smaller than a set value E1 among the values of the print area rates E calculated in the first calculating section.

3. An apparatus of claim 1, further comprising:

a second memory section which stores a reference developing agent consumption fee Ms per unit area rate of the print area rate on the paper-sheet, when the original of the reference size on which the image is depicted at the standard print area rate Es is read by the present apparatus and printed on the paper-sheet;

a third calculating section which calculates a developing agent consumption fee M per paper-sheet by multiplying the average print area rate Ea calculated in the second calculating section by the reference developing agent consumption fee Ms in the second memory section; and an informing section to inform the reference developing agent consumption fee Ms calculated in the third calculating section.

4. An image forming apparatus comprising:

an original table;

a reading section which optically reads an image on an original set on the original table;

a printing section which divides each picture element of the image read in the reading section into a plurality of picture elements, forms a latent image on a photosensitive member in accordance with the divided picture elements, and then develops the latent image with a developing agent to print it on a paper-sheet;

a picture element counter which counts, every paper-sheet, the number G of the divided picture elements which become targets of the development among the divided picture elements;

a first memory section which stores, every reference size, the number Gs of reference divided picture elements per unit area rate of a print area rate on the paper-sheet, when an original of a reference size on which an image is depicted at a standard print area rate Es is read by the present apparatus and printed on the paper-sheet;

an operating section;

a designating section which designates the reference size in accordance with the operation of the operating section;

a first selection section which selects the number Gs of the reference divided picture elements corresponding to the reference size designated in the designating section among the numbers Gs of the reference divided picture elements in the first memory section;

a first calculating section which calculates a print area rate E on the paper-sheet by dividing the counted value G of the picture element counter by the number Gs of the reference divided picture elements selected in the first selection section;

a sheet number counter to count the number U of the used paper-sheets;

a converting section which converts the counted number U of the sheet number counter to the number Ux of the paper-sheets of the reference size designated in the designating section;

a second calculating section which accumulates the print area rates E calculated in the first calculating section, and calculates an average print area rate Ea dividing the accumulated value by the converted number Ux of the converting section; and an informing section which informs the converted number Ux of the converting section and the average print area rate Ea calculated in the second calculating section, and informs the print area rate E last calculated at present among the print area rates E calculated in the first calculating section.

5. An apparatus of claim 4, further comprising:

an adjusting section which adjusts the number Gs of the reference divided picture elements in the first memory section in accordance with the operation of the operating section; and a correcting section which corrects, to 100%, a value near to 100% and larger than a set value E2, and corrects, to 100%, a value near to 0% and smaller than a set value E1 among the print area rates E calculated in the first calculating section.

6. An apparatus of claim 4, further comprising:

a second memory section which stores, every reference size, the reference developing agent consumption fee Ms per unit area rate of the print area rate on the paper-sheet, when the original of the reference size on which the image is depicted at the standard print area rate Es is read by the present apparatus and printed on the paper-sheet;

a second selection section which selects the reference developing agent consumption fee Ms corresponding to the reference size designated in the designating section among the reference developing agent consumption fees Ms in the second memory section;

a third calculating section which calculates a developing agent consumption fee M per paper-sheet by multiplying the average print area rate Ea calculated in the second calculating section by the reference developing agent consumption fee Ms selected in the second selection section; and an informing section which informs the reference developing agent consumption fee Ms calculated in the third calculating section.

7. An image forming apparatus comprising:

an original table;

a reading section which optically reads an image on an original set on the original table;

a printing section which divides each picture element of the image read in the reading section into a plurality of picture elements, forms a latent image on a photosensitive member in accordance with the divided picture elements, and then develops the latent image with a developing agent to print it on a paper-sheet;

a picture element counter which counts, every paper-sheet, the number G of the divided picture elements which become targets of the development among the divided picture elements;

an input section into which an image transmitted from an external device is inputted at a printer mode, wherein:

the printing section which divides each picture element of the image read in the reading section and the image inputted into the input section into the plurality of picture elements, respectively, forms the latent image corresponding to the divided picture elements on a photosensitive member, and then develops the latent image with a developing agent to print it on the paper-sheet; and the picture element counter which counts, every paper-sheet and every mode of the copy mode and the printer mode, the number G of the divided picture elements which become targets of the development among the divided picture elements;

a first memory section which stores, every reference size, the number Gs of reference divided picture elements per unit area rate of a print area rate on the paper-sheet, when an original of a reference size on which an image is depicted at a standard print area rate Es is read by the present apparatus and printed on the paper-sheet;

an operating section;

a designating section which designates one of the reference sizes in accordance with the operation of the operating section;

a first selection section which selects the number Gs of the reference divided picture elements corresponding to the reference size designated in the designating section among the numbers Gs of the reference divided picture elements in the first memory section;

a first calculating section which calculates, every mode, the print area rate E on the paper-sheet by dividing the counted value G of the picture element counter by the number Gs of the reference divided picture elements selected in the first selection section;

a sheet number counter to count the number U of the used paper-sheets every mode;

a converting section which converts the counted number U of the sheet number counter to the number Ux of the sheet having the reference size designated in the designating section;

a second calculating section which accumulates print area rates E calculated in the first calculating section, and calculates an average print area rate Ea every mode by dividing the accumulated value by the converted number Ux of the converting section; and an informing section which informs the converted number Ux of the converting section and the average print area rate Ea calculated in the second calculating section, and informs the print area rate E last calculated at present among the print area rates E calculated in the first calculating section.

8. An apparatus of claim 7, further comprising:

an adjusting section which adjusts the number Gs of the reference divided picture elements in the first memory section in accordance with the operation of the operating section; and a correcting section which corrects, to 100%, a value near to 100% and larger than a set value E2, and corrects, to 0%, a value near to 0% and smaller than a set value E1 among the print area rates E calculated in the first calculating section.

9. An apparatus of claim 8, wherein the informing section comprises a liquid crystal display section disposed on an external peripheral surface of a main body of the apparatus, and a display control section which displays informed contents as a display screen of a developing agent consumption state on the liquid crystal display section.

10. An apparatus of claim 9, further comprising:

a choice section which chooses, by a manual operation, whether or not the display screen of the developing agent consumption state is displayed in the liquid crystal display section.

11. An apparatus of claim 9, further comprising:

a print control section which prints the display contents of the display screen of the developing agent consumption state on the paper-sheet as an image formation output of the apparatus.

12. An apparatus of claim 9, further comprising:

an outward transmission control section which outward transmits the display contents of the display screen of the developing agent consumption state through communication networks.

13. An apparatus of claim 7, further comprising:

a second memory section which stores, every reference size, the reference developing agent consumption fee Ms per unit area rate of the print area rate on the paper-sheet, when the original of the reference size on which the image is depicted at the standard print area rate Es is read by the present apparatus and printed on the paper-sheet;

a second selection section which selects the reference developing agent consumption fee Ms corresponding to the reference size designated in the designating section among the reference developing agent consumption fees Ms in the second memory section;

a third calculating section which calculates, every mode, a developing agent consumption fee M per paper-sheet by multiplying the average print area rate Ea calculated in the second calculating section by the unit price Ms selected in the second selection section; and an informing section which informs the reference developing agent consumption fee M calculated in the third calculating section.

14. An apparatus of claim 7, further comprising:

a reset section which resets the counted value G of the picture element counter and the counted value U of the sheet number counter by a manual operation.

15. An apparatus of claim 7, further comprising:

a reset section which automatically resets resetting the counted value G of the picture element counter and the counted value U of the sheet number counter when replacing a supply cartridge of the developing agent.

16. An apparatus of claim 7, further comprising:

a first reset section which resets the counted value G of the picture element counter and the counted value U of the sheet number counter by a manual operation;

a second reset section which automatically resets resetting the counted value G of the picture element counter and the counted value U of the sheet number counter when replacing a supply cartridge of the developing agent; and a reset mode selection section which selects one of a mode to perform the first reset section and a mode to perform the second reset section by a manual operation.

* * * * *